US007128955B2

(12) United States Patent
Monju

(10) Patent No.: US 7,128,955 B2
(45) Date of Patent: Oct. 31, 2006

(54) THERMAL TRANSFER RECORDING MEDIUM AND PHOTOGRAPHIC PRINT

(75) Inventor: Takuya Monju, Tochigi (JP)

(73) Assignees: Sony Corporation, Tokyo (JP); Sony Chemical & Information Device Corporation, Tokyo (JP)

( * ) Notice: Subject to any disclaimer, the term of this patent is extended or adjusted under 35 U.S.C. 154(b) by 0 days.

(21) Appl. No.: 10/506,581

(22) PCT Filed: Mar. 5, 2003

(86) PCT No.: PCT/JP03/02590

§ 371 (c)(1),
(2), (4) Date: Mar. 17, 2005

(87) PCT Pub. No.: WO03/074288

PCT Pub. Date: Sep. 12, 2003

(65) Prior Publication Data

US 2005/0163946 A1 Jul. 28, 2005

(30) Foreign Application Priority Data

Mar. 5, 2002 (JP) ..... 2002-058418

(51) Int. Cl.
*B41M 5/40* (2006.01)

(52) U.S. Cl. ..... 428/32.52; 428/32.76; 428/32.81; 503/227

(58) Field of Classification Search ..... None
See application file for complete search history.

(56) References Cited

U.S. PATENT DOCUMENTS 4,707,406 A * 11/1987 Inaba et al. ..... 428/32.61
5,279,884 A * 1/1994 Kitamura et al. ..... 428/32.81
5,318,943 A * 6/1994 Ueno et al. ..... 503/227
5,556,701 A 9/1996 Abe et al.
5,776,595 A 7/1998 Kurokawa et al.
5,843,563 A * 12/1998 Tuyuguchi et al. ..... 428/32.76
5,853,898 A 12/1998 Obara et al.
5,908,252 A 6/1999 Harada et al.
6,190,765 B1 * 2/2001 Idehara et al. ..... 428/32.81
6,696,119 B1 * 2/2004 Obara et al. ..... 428/32.8

FOREIGN PATENT DOCUMENTS

| | | |
|---|---|---|
| EP | 0 389 635 | 10/1990 |
| JP | 7-156560 | 6/1995 |
| JP | 7-172075 | 7/1995 |

(Continued)

*Primary Examiner*—Jennifer C. McNeil
*Assistant Examiner*—Timothy M. Speer
(74) *Attorney, Agent, or Firm*—Frommer Lawrence & Haug LLP; William S. Frommer

(57) ABSTRACT

A thermal transfer recording medium 1 according to the present invention is to obtain a reliable printed matter with no space between picture information and a protective film thereof and has a melting type transfer portion $\mathbf{16}_1$ including a melting type primer layer $\mathbf{18}_1$ whose main component is styrene vinyl acetate copolymer and a melting type ink layer $\mathbf{17}_1$. Since styrene vinyl acetate copolymer softens or melts by heating to lose mechanical strength thereof, the melting type transfer portion $\mathbf{16}_1$ is transferred with ease from a base sheet 11 by heating to form a printing layer 47. On the surface of the printing layer 47, a residual resin 49 formed of material of the melting type primer layer $\mathbf{18}_1$ is exposed; however, since styrene vinyl acetate copolymer sticks well to a thermoplastic resin existing on the surface portion of a protective portion $\mathbf{25}_1$, there is no space generated between the protective portion $\mathbf{25}_1$ and the printing layer 47.

6 Claims, 4 Drawing Sheets

FOREIGN PATENT DOCUMENTS

| | | |
|---|---|---|
| JP | 7-232483 | 9/1995 |
| JP | 7-290848 | 11/1995 |
| JP | 9-20085 | 1/1997 |
| JP | 9-164777 | 6/1997 |
| JP | 9-267498 | 10/1997 |
| JP | 10-138643 | 5/1998 |
| JP | 11-321118 | 11/1999 |
| JP | 2001-265043 | 9/2001 |
| WO | WO 90/02048 | 3/1990 |

* cited by examiner

THERMAL TRANSFER RECORDING MEDIUM AND PHOTOGRAPHIC PRINT

TECHNICAL FIELD

The present invention relates to a thermal transfer recording medium and a printed matter which are suitable to be applied to a thermal transfer printer.

BACKGROUND ART

As shown in a schematic cross-sectional view of FIG. 7, a conventional thermal transfer recording medium 101 used for a thermal transfer printer includes a base sheet 111 and an ink layer 116 disposed on the base sheet 111.

A primer layer 115, whose main component is wax, is disposed between the ink layer 116 and the base sheet 111, and the ink layer 116 is fixed to the base sheet 111 with the primer layer 115 in between.

To execute printing using the thermal transfer recording medium 101, a heating head is pressed to a surface of the thermal transfer recording medium 101 that is the opposite side to the ink layer 116 and the surface of the ink layer 116 is brought in firm contact with a recording sheet.

The heating head is made to conduct electricity and the thermal transfer recording medium 101 is heated by means of thermal conductivity. With this, a heated part of the primer layer 115 is got soft or melts.

When the thermal transfer recording medium 101 and the recording sheet are shifted relatively to the heating head, the ink layer 116 adheres to the recording sheet at a part where the thermal transfer recording medium 101 is separated from the heating head.

In the above state of the thermal transfer recording medium 101 separated from the recording sheet, cohesive failure is caused in the melted primer layer 115, and the above-described heated part of the ink layer 116 is transferred to the recording sheet. In this manner, information on a picture such as characters, figures, etc. is formed on the recording sheet by the collection of transferred ink, and the intended printing is executed.

On the other hand, in order to enhance a preservation property and lustrous property there is a case in which a protective portion formed of transparent resin, namely a protective film, is laminated on the surface of a recording sheet where picture information has been formed, namely on the printing surface.

However, the above-described primer layer 115 having a cohesive failure may stick on the surface of the above-described transferred ink; and since the wax constituting this primer layer 115 and the protective film do not bond together due to lack of sufficient adhesiveness thereof, the protective film and the ink do not stick to each other, so that there may be caused a lift between the protective film and the printing surface to deteriorate the reliability of the protecting function thereof.

DISCLOSURE OF THE INVENTION

An object of the present invention is to solve the above-described problem and to manufacture a printed matter in which no lift is generated between a protective film and a printing surface.

Specifically, the thermal transfer recording medium according to the present invention is a thermal transfer recording medium including a base sheet, a melting type primer layer disposed on the base sheet, and a melting type ink layer disposed on the melting type primer layer, in which the melting type primer layer and the melting type ink layer constitute a melting type transfer portion, the melting type transfer portion is transferred to a printing object by heating the melting type transfer portion, and a printing layer where a residual resin formed from the material of the primer layer is exposed; and the main component of the material which forms the melting type primer layer is styrene vinyl acetate copolymer.

Further, the melting type ink layer in the thermal transfer recording medium according to the present invention can be made of black ink containing carbon black.

Further, the thermal transfer recording medium according to the present invention includes a sublimatic transfer portion which is disposed on the base sheet and contains sublimation type ink; and by heating the sublimatic transfer portion with being in firm contact with the printing object, the sublimation type ink sublimates and infiltrate into the printing object.

Further, in the thermal transfer recording medium according to the present invention, the styrene vinyl acetate copolymer contained in a melting type primer layer contains vinyl acetate of 10 mol % or more and 50 mol % or less.

Further, in the thermal transfer recording medium according to the present invention, the melting type primer layer contains the styrene vinyl acetate copolymer 60 wt % or more.

Further, in the thermal transfer recording medium according to the present invention, polyethylene wax is added to the melting type primer layer.

Furthermore, the thermal transfer recording medium according to the present invention may have a protective portion disposed on the base sheet, in which when heat is applied, the surface of the protective portion becomes adhesive with respect to the above described residual resin.

Further, in the thermal transfer recording medium according to the present invention, the protective portion contains one kind of resin selected from a group consisting of acrylic resin, polyester resin, vinyl chloride resin, nitrocellulose resin and urethane resin.

Then, the printed matter according to the present invention includes a recording sheet and a printing layer disposed on the surface of the recording sheet, in which a residual resin whose main component is styrene vinyl acetate copolymer is disposed on the surface of the printing layer and a protective portion which adheres both to the residual resin and to the recording sheet is included.

As described above, the thermal transfer recording medium according to the present invention is the one in which a melting type primer layer contains styrene vinyl acetate copolymer; and though firmly fixing a melting type ink layer to a base sheet at a normal temperature, the primer layer containing styrene vinyl acetate copolymer fixes melts or softens when heated, to lower the mechanical strength thereof greatly.

Therefore, if the thermal transfer recording medium is separated from the recording sheet after a part which should be printed is heated with a recording sheet being firmly in contact with the melting type transfer portion, in a heated part of the melting type primer layer the cohesive failure occurs with ease, and a part of the melting type primer layer which has undergone cohesive failure is transferred to the recording sheet along with a heated part of the ink layer, thereby forming a printed object.

Accordingly, a residual resin made of a part of the melting type primer layer is exposed to the surface of the printing layer due to the transfer of the part of the cohesively failed primer layer together with the printing layer; however, since the styrene vinyl acetate copolymer contained in the melting type primer layer has high adhesiveness to a resin constituting a protective film (namely the protective portion) such as acrylic resin, no lift occurs between the printing layer and a protective film in the case where the protective film is attached to the surface on which the printing layer has been formed, so that a printed matter with reliability can be obtained.

In the case where the material constituting the recording sheet is vinyl chloride resin, the protective portion having high adhesiveness with respect to the vinyl chloride resin can also be stuck to the residual resin whose main component is styrene vinyl acetate copolymer.

As the material for the protective portion, various kinds of thermoplastic resin such as acrylic resin, polyester resin, vinyl chloride resin, nitrocellulose resin or urethane resin can be used; among those, acrylic resin has particularly high adhesiveness both to styrene vinyl acetate copolymer and to vinyl chloride resin, so that a printed matter having further reliability can be obtained if acrylic resin is contained in the surface part of the protective portion.

Since the sublimation type ink has a color different from that of the melting type ink, multicolored printing can be performed if the thermal transfer recording medium according to the present invention is used.

Further, if at least three kinds of sublimation type transfer portion are formed, and each sublimation type ink layer of respective transfer portions is formed of the primary colors of red, blue, and yellow, color printing can be performed with one thermal transfer recording medium.

BEST MODE OF CARRYING OUT THE INVENTION

Hereinafter, the thermal transfer recording medium according to the present invention will be explained in detail.

Figure 1:
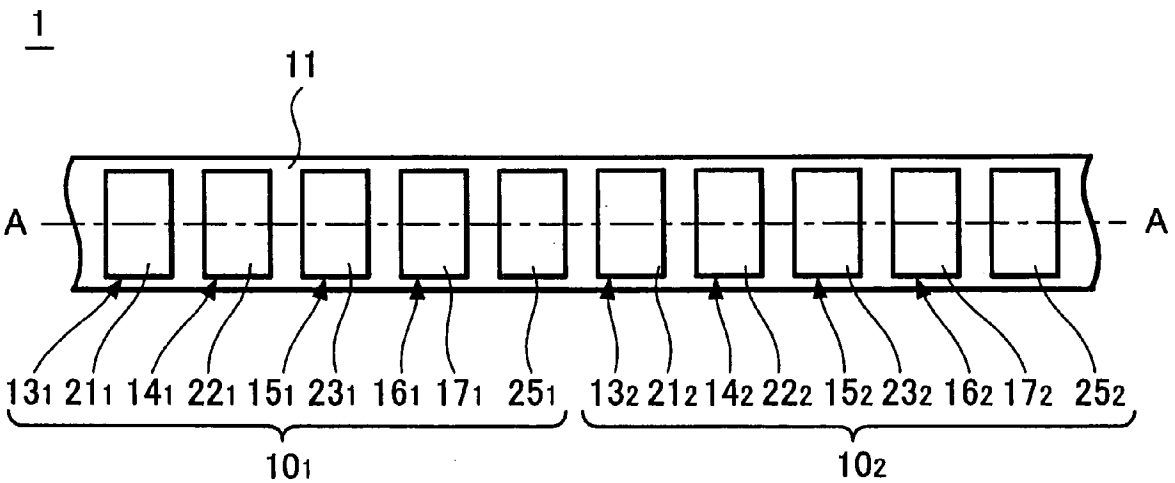
FIG. 1 is a plan view for explaining an example of a thermal transfer recording medium according to the present invention.
Figure 2:
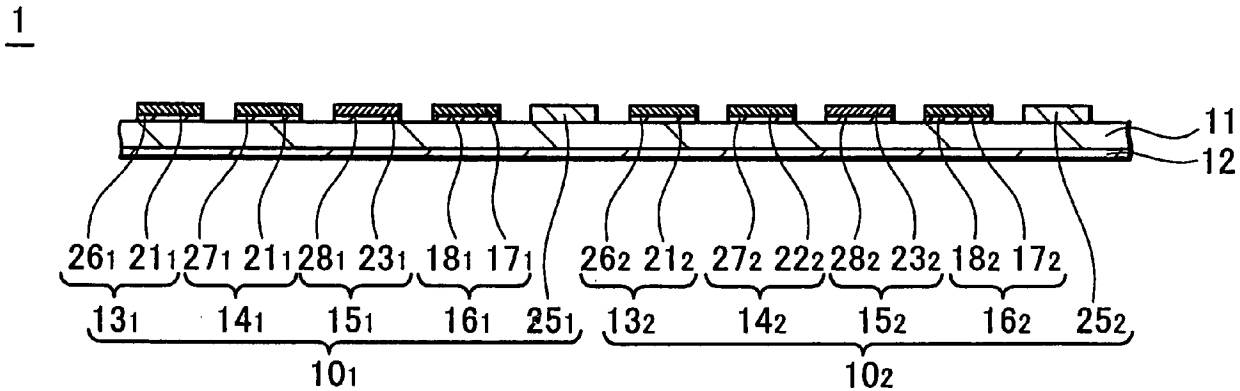
FIG. 2 is a cross-sectional view taken by the A—A line in FIG. 1.

FIG. 1 is a plan view showing an example of a thermal transfer recording medium 1 according to the present invention, and FIG. 2 shows a cross-sectional view taken by the A—A line in FIG. 1.

In this example, a thermal transfer recording medium in the shape of tape is used and has a base sheet 11 made of a resin film.

A plurality of printing units are disposed in the longitudinal direction on the base sheet 11. In the figure, two printing units $\mathbf{10}_1$ and $\mathbf{10}_2$ are shown, and each of the printing units $\mathbf{10}_1$ and $\mathbf{10}_2$ is used for one recording sheet, which is a printing object for the thermal transfer recording medium 1.

Since the printing units $\mathbf{10}_1$ and $\mathbf{10}_2$ have the same structure, only one printing unit $\mathbf{10}_1$ is here explained; one printing unit $\mathbf{10}_1$ has a plurality of (three in this example) sublimation type transfer portions $\mathbf{13}_1$, $\mathbf{14}_1$ and $\mathbf{15}_1$, one melting type transfer portion $\mathbf{16}_1$ and one protective portion $\mathbf{25}_1$.

The thermal transfer recording medium 1 is conveyed in one direction in a printer when used for printing a recording sheet; and in one printing unit $\mathbf{10}_1$, the three sublimation type transfer portions $\mathbf{13}_1$, $\mathbf{14}_1$ and $\mathbf{15}_1$ are disposed at predetermined intervals in this order from the front in the forward direction, and behind those, the melting type transfer portion $\mathbf{16}_1$ and the protective portion $\mathbf{25}_1$ are disposed in this order.

In FIGS. 1 and 2, the left-hand side of the figure is the forward direction of the conveyance, and the right-hand side of the figure is the source of the conveyance.

The sublimation type transfer portions $\mathbf{13}_1$, $\mathbf{14}_1$ and $\mathbf{15}_1$ respectively have sublimatic primer layers $\mathbf{26}_1$, $\mathbf{27}_1$ and $\mathbf{28}_1$ disposed on the base sheet 11, and sublimation type ink layers $\mathbf{21}_1$, $\mathbf{22}_1$ and $\mathbf{23}_1$ disposed on those sublimatic primer layers $\mathbf{26}_1$, $\mathbf{27}_1$ and $\mathbf{28}_1$.

All the sublimatic primer layers $\mathbf{26}_1$, $\mathbf{27}_1$ and $\mathbf{28}_1$ are made of the same material, and each of the sublimation type ink layers $\mathbf{21}_1$, $\mathbf{22}_1$ and $\mathbf{23}_1$ in one printing unit $\mathbf{10}_1$ contains a sublimatic dye as coloring agent, whose color is different from one another.

In this example, the sublimation type transfer portions $\mathbf{13}_1$, $\mathbf{14}_1$ and $\mathbf{15}_1$ containing yellow dye, magenta dye and cyan dye, respectively are disposed in this order from the front.

Also, the melting type transfer portion $\mathbf{16}_1$ includes a melting type primer layer $\mathbf{18}_1$ disposed on a base sheet 11 and a melting type ink layer $\mathbf{17}_1$ disposed on the melting type primer layer $\mathbf{18}_1$.

The melting type primer layer $\mathbf{18}_1$ is formed of a material different from the sublimatic primer layers $\mathbf{26}_1$, $\mathbf{27}_1$ and $\mathbf{28}_1$, and on printing described later on, the sublimatic primer layers $\mathbf{26}_1$, $\mathbf{27}_1$ and $\mathbf{28}_1$ are fixed to the base sheet 11 without softening or melting by heating; however, the melting type primer layer $\mathbf{18}_1$ softens or melts by heating and is exfoliated within the melting type primer layer $\mathbf{18}_1$.

The melting type ink layer $\mathbf{17}_1$ has a coloring agent of a different color from the above-described sublimation type ink layers $\mathbf{21}_1$, $\mathbf{22}_1$ and $\mathbf{23}_1$; and when the melting type ink layer $\mathbf{17}_1$ is heated, the coloring agent does not sublimate and the whole of the melting type ink layer $\mathbf{17}_1$ softens or melts to become adhesive. In this example, the melting type ink layer $\mathbf{17}_1$ is made of black ink containing carbon black as the coloring agent.

Regarding the front and rear surfaces of the base sheet 11, a rear surface layer 12 is provided on the surface opposite to the printing units $\mathbf{10}_1$ and $\mathbf{10}_2$. Since the main component of the material forming the rear surface layer 12 is a resin having a high heat resistance, the base sheet 11 is not thermally deformed or damaged when the thermal transfer recording medium 1 is heated by pressing a heating head described later on to the rear surface layer 12 and making the heating head generate heat.

Hereinafter, a process in which printing is performed on a recording sheet, which is a printing object, using the above-described thermal transfer recording medium 1 is explained.

Figure 3A:
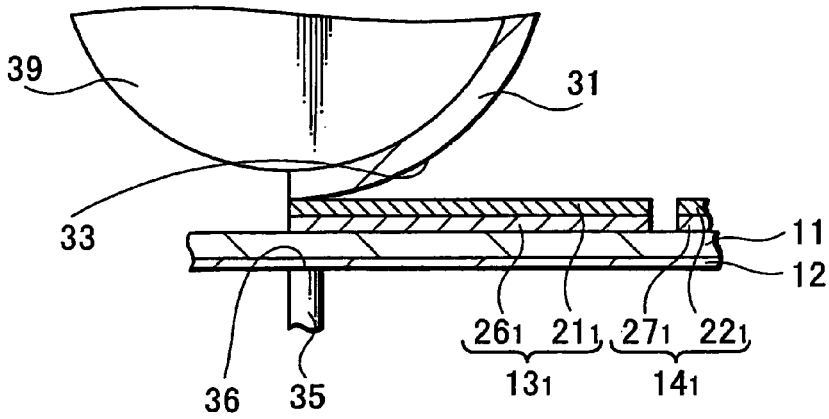
FIGS. 3A and 3B are cross-sectional views for explaining the first half of a process in which printing is executed using the thermal transfer recording medium according to the present invention.

FIG. 3A shows a state in which predetermined information such as characters, figures, etc. is being printed on a recording sheet 31 by the first yellow color sublimation type transfer portion $\mathbf{13}_1$ in the three color sublimation type transfer portions $\mathbf{13}_1$, $\mathbf{14}_1$ and $\mathbf{15}_1$; and the recording sheet 31 to be printed has been inserted into a printer, in which the thermal transfer recording medium 1 is installed, to be conveyed between a heating head 35 and a pressing roller 39 with the front of one printing unit $\mathbf{10}_1$ being aligned.

The heating head 35 is disposed on the side of the rear surface layer 12 of the thermal transfer recording medium 1, and the pressing roller 39 is disposed on the side of the recording sheet 31, which is opposite to the rear surface layer 12 side; while the thermal transfer recording medium 1 and the recording sheet 31 are stopped, a heating surface 36 of the heating head 35 is come in contact with the surface of the rear surface layer 12, and the thermal transfer recording medium 1 and the recording sheet 31 are pressed to the pressing roller 39, a printing surface 33 of the recording sheet 31 is firmly in contact with the sublimation type ink layer $\mathbf{21}_1$ of the sublimation type transfer portion $\mathbf{13}_1$.

The heating surface 36 of the heating head 35 has a rectangular shape and is brought in contact with the surface of the rear surface layer 12 perpendicularly to the traveling direction of a thermal transfer recording medium 31.

Also, heating elements are disposed inside the heating head 35; and when heating elements at a position corresponding to a printing pattern is made to generate heat while the thermal transfer recording medium 1 is pressed by the heating head 35 and the pressing roller 39 to the recording sheet 31, dye in the sublimation type ink layer $\mathbf{21}_1$ sublimates according to the pattern of the heating element heated.

The sublimated dye infiltrates into the recording sheet 31, and so printing is performed on the recording sheet 31 with the first color ink layer $\mathbf{21}_1$.

Since a region to be printed in the recording sheet 31 is longer than the width of the heating surface 36, picture information such as characters, figures, etc. can be printed in a desired region on the recording sheet 31 by the first color sublimation type transfer portion $\mathbf{13}_1$, when printing by means of generating heat, and the conveyance of the recording sheet 31 and the thermal transfer recording medium 31 are repeated alternately.

Once printing the first color picture information is finished, the head position of the sublimation type transfer portion $\mathbf{14}_1$ subsequently positioned to be used for the next printing is set to the position of the heating head 35, and the head of the recording sheet 31 is disposed again at the position of the heating head 35.

After printing is executed by the second color sublimation type transfer portion $\mathbf{14}_1$ using the same procedure as the first color sublimation type transfer portion $\mathbf{13}_1$, the head position of the third color sublimation type transfer portion $\mathbf{15}_1$ and the head position of the recording sheet 31 are disposed at the position of the heating head 35 and then printing by the third color sublimation type transfer portion $\mathbf{15}_1$ is executed.

Note that, since the primer layers $\mathbf{26}_1$, $\mathbf{27}_1$ and $\mathbf{28}_1$ of the sublimation type transfer portions $\mathbf{13}_1$, $\mathbf{14}_1$ and $\mathbf{15}_1$ do not melt or soften by heating, and the primer layers $\mathbf{26}_1$, $\mathbf{27}_1$ and $\mathbf{28}_1$ do not exfoliate during printing, a material forming the primer layers $\mathbf{26}_1$, $\mathbf{27}_1$ and $\mathbf{28}_1$ never stick to picture information printed by the sublimation type transfer portions $\mathbf{13}_1$, $\mathbf{14}_1$ and $\mathbf{15}_1$.

Next, a process in which printing is executed by the melting type transfer portion $\mathbf{16}_1$ is explained.

Figure 3B:
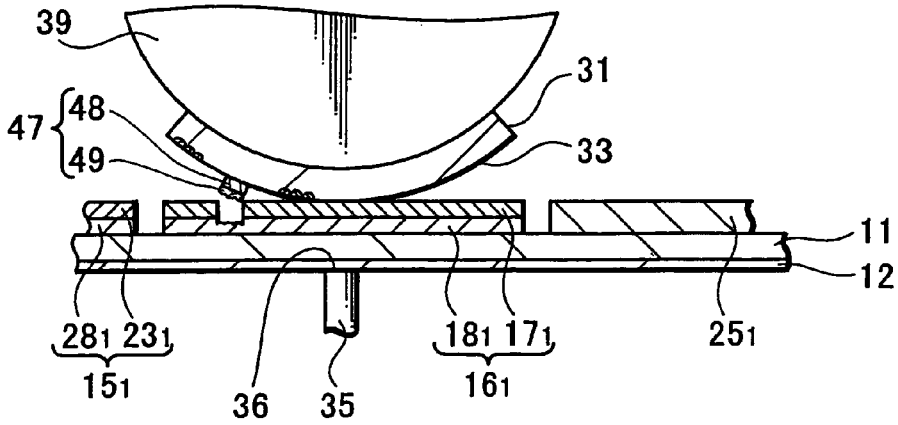

FIG. 3B shows a state in which predetermined information is being printed on the recording sheet 31 by the melting type transfer portion $\mathbf{16}_1$; and while the recording sheet 31 and the melting type transfer portion $\mathbf{16}_1$ is stopped at the position of the heating head 35, the thermal transfer recording medium 1 is pressed by the heating head 35 and the melting type transfer portion $\mathbf{16}_1$ is being pressed to the printing surface 33.

A position of the melting type transfer portion $\mathbf{16}_1$, corresponding to a pattern for printing is being heated by the heating head 35; and at the heated part, the surface part of the melting type ink layer $\mathbf{17}_1$ causes stickiness, and the melting type transfer portion $\mathbf{16}_1$ is therefore stuck to the printing surface 33.

Since at the heated part of the melting type transfer portion $\mathbf{16}_1$ the melting type primer layer $\mathbf{18}_1$ is softened or melted and the mechanical strength thereof becomes lessened, the heated part of the melting type transfer portion $\mathbf{16}_1$ detaches from the base sheet 11 inside the melting type primer layer $\mathbf{18}_1$ and then transferred to the recording sheet 31, when the thermal transfer recording medium 1 and the recording sheet 31 are conveyed in the forward direction, pressure by the heating head 35 is released, and the recording sheet 31 detaches from the thermal transfer recording medium 1.

A printing layer 47 made from the melting type transfer portion $\mathbf{16}_1$ includes a melting type ink 48 which firmly adheres to the printing surface 33, and a material (residual resin) 49 constituting a melting type ink layer $\mathbf{18}_1$ is attached to the surface of the melting type ink 48.

With the melting type ink 48 made of black ink, when printing for the width of the melting type transfer portion $\mathbf{16}_1$ and conveyance for the width of the heating surface 36 of the recording sheet 31 and the thermal transfer recording medium 31 are repeated alternately, black picture information made of a pattern of the printing layer 47 is printed in a desired region of the printing surface 33.

Figure 4A:
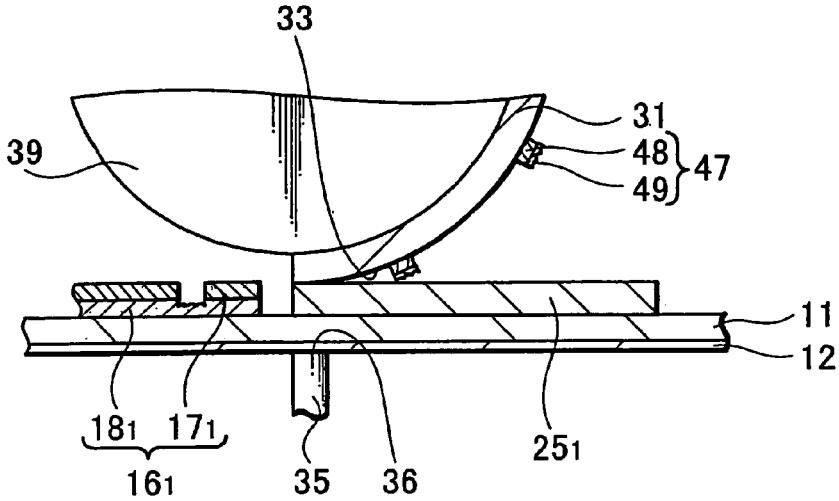
FIGS. 4A and 4B are cross-sectional views for explaining the second half of the process in which printing is executed using the thermal transfer recording medium according to the present invention.

In the state where the black picture information is formed, the protective portion $\mathbf{25}_1$ used for the next printing is disposed further subsequently to the melting type transfer portion $\mathbf{16}_1$; and when the thermal transfer recording medium 1 is conveyed in the forward direction, the recording sheet 31 is returned in the direction reverse to the forward direction, the head position of the protective portion $\mathbf{25}_1$ and the head position of the recording sheet 31 are stopped at the position of the heating head 35, and the heating head 35 is pressed to the thermal transfer recording medium 1, the protective portion $\mathbf{25}_1$ comes in contact with at least one of the followings: picture information by the melting type transfer portion $\mathbf{16}_1$, picture information by the sublimation type transfer portions $\mathbf{13}_1$, $\mathbf{14}_1$ and $\mathbf{15}_1$, and the printing surface 33 in the vicinity of picture information, as shown in FIG. 4A.

With that state, if the whole heating surface 36 is made to generate heat, all the part of the protective portion $\mathbf{25}_1$ pressed by the heating head 35 is heated.

Since the protective portion $\mathbf{25}_1$ is formed of a thermoplastic resin (acrylic resin in this example) which becomes adhesive when heated, the pressed part of the protective portion $\mathbf{25}_1$ is affixed to the part of the recording sheet 31 with which the protective portion $\mathbf{25}_1$ is firmly contacted.

Picture information by the sublimation type transfer portions $13_1$, $14_1$ and $15_1$ is formed of the surface part of the recording sheet 31, and no materials of the sublimatic primer layers $26_1$, $27_1$ and $28_1$ are attached. Since vinyl chloride resin and acrylic resin adhere well to each other, the protective portion $25_1$ made of acrylic resin adheres both to the recording sheet 31 made of vinyl chloride resin and to the picture information made from the surface part of the recording sheet 31.

Further, the residual resin 49 is exposed to the surface of the printing layer 47 constituting picture information by the melting type transfer portion $16_1$; however, since the main component of the material forming the residual resin 49 is styrene vinyl acetate copolymer which is highly adhesive to acrylic resin, the protective portion $25_1$ made of acrylic resin is also stuck to the residual resin 49 whose main component is styrene vinyl acetate copolymer.

Figure 4B:
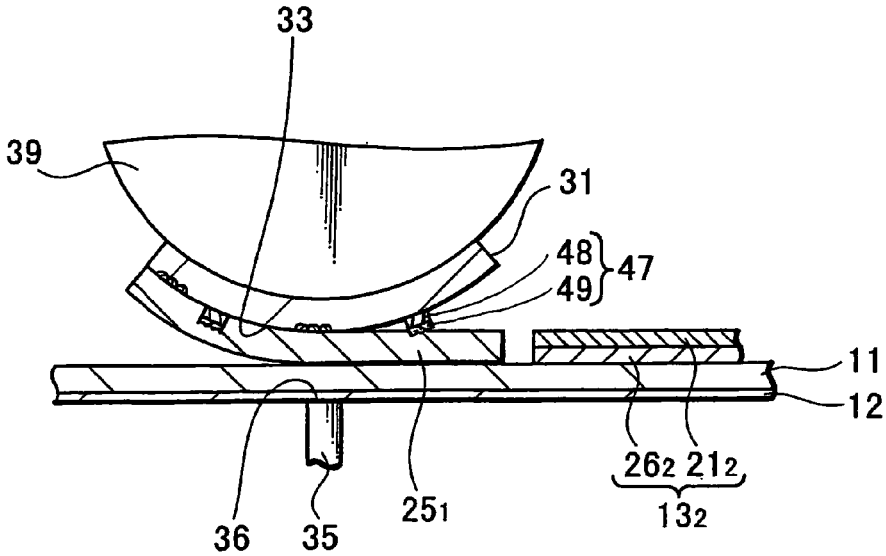

When the recording sheet 31 and the thermal transfer recording medium 1 are conveyed in the forward direction, pressure on the protective portion $25_1$ caused by the heating head 35 is released, and the recording sheet 31 detaches from the thermal transfer recording medium 1, the protective portion $25_1$ stuck to the recording sheet 31 is exfoliated from the base sheet 11, so that as shown in FIG. 4B the protective portion $25_1$ is transferred and stuck to the recording sheet 31.

Figure 5:
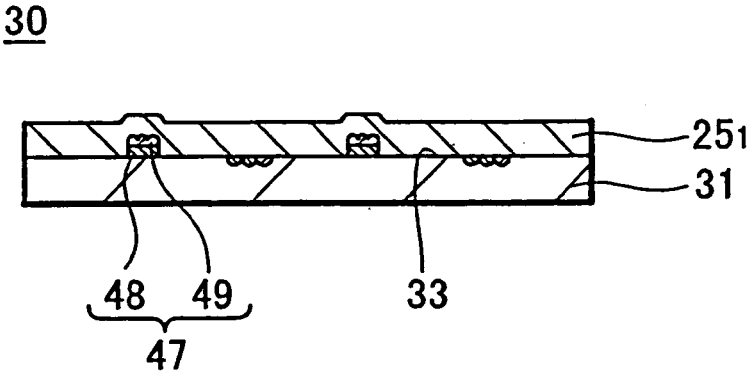
FIG. 5 is a cross-sectional view for explaining an example of a printed matter according to the present invention.

After heating the width of the protective portion $25_1$, and conveying the width of the heating surface 36 of the recording sheet 31 and the thermal transfer recording medium 1 are executed repeatedly, the protective portion $25_1$ is transferred and attached to the desired entire region of the printing surface 33, so that such a printed matter 30 as shown in FIG. 5 can be obtained.

Since the protective portion $25_1$ made of acrylic resin and the recording sheet 31 made of vinyl chloride resin adhere well to each other, and also the protective portion $25_1$ made of acrylic resin and the residual resin 49 whose main component is styrene vinyl acetate copolymer adhere well to each other, the protective portion $25_1$ can be prevented from exfoliating off the recording sheet 31 even if the temperature surrounding the printed matter 30 changes or impact is physically applied to the printed matter 30 to some extent.

In addition, the acrylic resin which forms the protective portion $25_1$ is transparent, so that picture information and text information can be observed from the surface on the side of the printed matter 30 where the protective portion $25_1$ has been transferred and attached.

Further, after the printed matter 30 obtained in the above-described process has been removed from the printer, if another recording sheet is set to the printer and another printing unit $10_2$ is conveyed to the position of the heating head 35 along with that recording sheet, printing can be performed on a plurality of recording sheets using one transfer recording medium 10.

Figure 6:
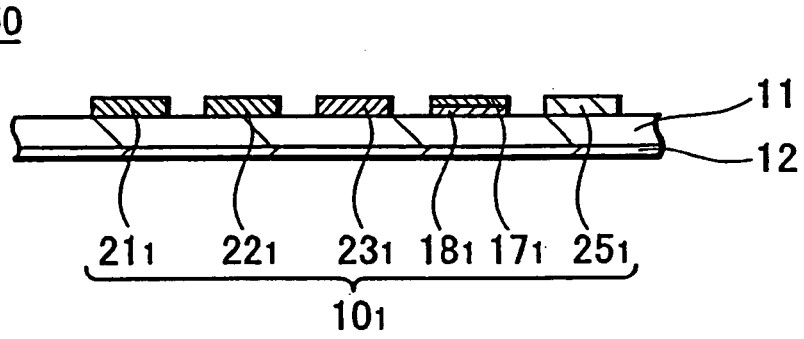
FIG. 6 is a cross-sectional view for explaining another example of the thermal transfer recording medium according to the present invention.
Figure 7:
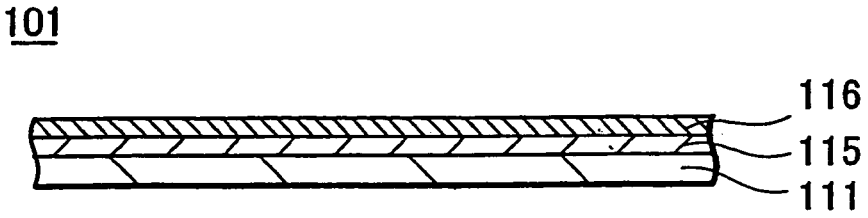
FIG. 7 PRIOR ART
FIG. 7 is a cross-sectional view of a conventional thermal transfer recording medium.

In the above-described example, a case in which the sublimation type transfer portions $13_1$ to $15_1$ each have a primer layer is explained; however, the present invention is not limited thereto, and as shown in the cross-sectional view of FIG. 6, a thermal transfer recording medium 50 may have a sublimation type transfer portion made of sublimation type ink, which is provided by forming the sublimation type ink layers $21_1$ to $23_1$ directly on the base sheet 11.

Further, in the above-described example, a case in which the transfer portions $13_1$ to $15_1$, $16_1$ and the protective portion $25_1$ are formed on the same base sheet 11 is explained; however, the present invention is not limited thereto. For example, after picture information has been formed by a thermal transfer recording medium only having a sublimation type transfer portion and a melting type transfer portion, a protective portion can be laminated using a thermal transfer recording medium only having a protective portion. Further, it is also possible to provide a plurality of thermal transfer recording media by forming a sublimation type transfer portion and a melting type transfer portion on respective base sheets separately; and then picture information by the sublimation type transfer portion and picture information by the melting type transfer portion can be printed separately.

Further, in the above-described example, a case in which the transfer portions $13_1$ to $15_1$, $16_1$ and the transfer and attachment portion $25_1$ are heated by the same heating head 35 is explained; however, the present invention is not limited thereto, and the transfer portions $13_1$ to $15_1$, $16_1$ and the protective portion $25_1$ can be heated using individual heating heads.

Further, in the above-described example, a case in which the protective portion $25_1$ has a single-layer structure is explained; however, the present invention is not limited thereto, and a case in which a protective portion includes a plurality of layers is included in the present invention as well. In this case, if a resin layer of thermoplastic resin is disposed at the surface of the protective portion, the protective portion can be stuck to the recording sheet 31.

Further, colors and kinds of sublimation type ink are not particularly restricted, so that various colors of sublimation type ink can be selected according to the purpose of printing.

As black ink constituting a melting type ink, one in which carbon black is dispersed into binder composed of a thermoplastic resin such as acrylic resin, polyester resin, etc. can be used. Also, colors and kinds of coloring agent that are added to melting type inks are not particularly restricted, so that various colors and kinds of pigment can be used.

The material constituting a recording sheet is not particularly restricted, and various kinds of resin, paper, etc. can be used. In addition, if a receptive layer in which dye can be well-fixed is provided on the printing surface of a recording sheet, picture information printed by a sublimation type transfer portion becomes clearer.

As an example of the printed matter 30 of the present invention, there is a card having high durability such as a driver's license card or ID card, in which a portrait by a sublimation type transfer portion, and text information by a melting type transfer portion are printed on a card made of a resin film and the picture information thereof is protected by a transparent protective portion.

Next, practice examples of the present invention will be explained.

[Practice Example 1]

A coating liquid for a rear surface layer was obtained by mixing up binder, filler, surfactant and solvent. In this example, polyvinylbutyral resin (brand name [BX-1] manufactured by Sekisui Chemical Co., Ltd.) and isocyanate resin were used as the binder, talc was used as the filler, an anion activator (brand name [Plysurf] manufactured by DAI-ICHI KOGYO SEIYAKU CO., LTD.) was used as the surfactant, and methylethylketone and toluene were used as the solvent.

Then, a base sheet 11 of 6 μm in film thickness (polyester film manufactured by Toray Industries, Inc.) was prepared, and after the coating liquid of 1.0 g/m$^2$ for a rear surface layer was applied to one surface of the base sheet 11, the entirety was dried to form a rear surface layer 12.

Next, a melting type primer layer coating liquid was obtained by mixing up 10 pts.wt. of styrene vinyl acetate copolymer and 90 pts.wt. of toluene. Note that in this example brand name [Modiper SV10B] manufactured by NOF Corporation, containing vinyl acetate 10 mol %, was used as the styrene vinyl acetate copolymer.

After 0.3 g/m$^2$ of this melting type primer layer coating liquid was applied to the surface opposite to the rear surface layer 12 of the base sheet 11, the entirety was dried to form a melting type primer layer 18$_1$.

Subsequently, a melting type ink made of black ink was provided by mixing up 8 pts.wt. of polyester resin (brand name [UE3215] manufactured by Unitika Ltd.), which is binder, 2 pts.wt. of carbon black, which is coloring agent, and 90 pts.wt. of methylethylketone, which is solvent.

The above melting type ink of 1.0 g/m$^2$ was applied to the surface of the melting type primer layer 18$_1$ and was dried to form a melting type ink layer 17$_1$, and a melting type transfer portion 16$_1$ consisting of the melting type primer layer 18$_1$ and the melting type ink layer 17$_1$ was obtained.

Further, sublimation type inks of three colors: yellow, magenta and cyan, and a coating liquid for a protective portion, containing acrylic resin were provided; and each ink and the coating liquid were directly applied to the surface on the side where a black ink layer 17 of the base sheet 11 was formed and dried to manufacture a thermal transfer recording medium 50 shown in FIG. 6, in which three kinds of sublimation type ink layers 21$_1$ to 23$_1$ and a protective portion 25$_1$ were formed.

[Printing Test], [Reliability Test] and [Applicability Test] have been carried out with respect to the thermal transfer recording medium 50.

[Printing Test]

Using the thermal transfer recording medium 50 of Practice Example 1, after forming a portrait of color picture information and a bar code picture of black picture information on the surface of a recording sheet 31, the protective portion 25$_1$ was transferred to obtain a printed matter 30.

In this example, a thermal transfer printer manufactured by Datacard Ltd. was used, and as the recording sheet 31, a card made of vinyl chloride resin of 0.76 mm in film thickness was used.

When forming a printed matter, evaluation as follows was made: a case in which the melting type transfer portion 16$_1$ was smoothly transferred to the recording sheet 31 was rated [O]; a case in which the melting type transfer portion 16$_1$ was transferred, but there was a lot of printing noise when printing was rated [Δ]; and a case in which there was far too much printing noise, or a crack or hole generated in the base sheet 11 when printing was rated [x]. The evaluation results are described in the [Exfoliative Property] section in the following table 1.

Also, after leaving the printed matter 30 at room temperature for 24 hours, observation was performed: and evaluation as follows was made: one in which the protective portion 25$_1$ firmly adhered to the recording sheet 31 without a lift was rated [O]; and one in which a lift was seen in the protective portion 25$_1$ was rated [x]. The evaluation results are described in the [Overprint Quality] section in the following table 1.

[Reliability Test]

Printing was executed on the same condition as the above-described [Printing Test] except that the protective portion 25$_1$ was not transferred, and a printed matter without a protective portion 25$_1$ was obtained.

By means of a clock meter type friction tester, a bar code picture of a printed matter 30 was rubbed back and forth 200 times with a cotton cloth, and then damage caused by the friction was observed with eyes. A case in which there was no damage to the bar code picture was rated [O]; a case in which a slight damage to the bars constituting the bar code picture was observed was rated [Δ]; and a case in which the bars constituting the bar code picture were partially missing so that possibly a bar code reader would fail to read was rated [x]. The evaluation results are described in the [Reliability Test] section in the following table 1.

[Applicability Test]

In the above-described process in which the thermal transfer recording medium 50 of Practice Example 1 was formed, evaluation as follows was made: when a melting type ink was applied to the melting type primer layer 18$_1$, a case in which the melting type ink was applied evenly and not repelled was rated [O]; a case in which a little unevenness was seen but the picture of a printed matter was not affected was rated [Δ]; and a case in which there was considerable unevenness to affect the picture of a printed matter was rated [x]. The evaluation results are described in the [Applicability Test] section in table 1 below.

TABLE 1

The Results of Evaluation

| | Printing Test | | | |
|---|---|---|---|---|
| | Exfoliative Property | Overprint Quality | Reliability | Applicability |
| Practice Example 1 | ○ | ○ | ○ | Δ |
| Practice Example 2 | ○ | ○ | ○ | Δ |
| Practice Example 3 | ○ | ○ | ○ | Δ |
| Practice Example 4 | ○ | ○ | ○ | ○ |
| Comparative Example 1 | ○ | X | — | X |
| Comparative Example 2 | X | X | — | ○ |
| Comparative Example 3 | ○ | X | ○ | ○ |
| Comparative Example 4 | X | ○ | — | X |

[Practice Example 2]

This example has a similar structure to that used in Practice Example 1; however, styrene vinyl acetate copolymer containing vinyl acetate 30 mol % was used instead of the styrene vinyl acetate copolymer used in Practice Example 1.

[Practice Example 3]

This example has a similar structure to that of Practice Example 1; however, styrene vinyl acetate copolymer containing vinyl acetate 50 mol % was used instead of the styrene vinyl acetate copolymer used in Practice Example 1.

[Practice Example 4]

In this example, a coating liquid for a primer layer was provided by mixing up 7 pts.wt. of styrene vinyl acetate copolymer used in Practice Example 1, 3 pts.wt. of polyethylene wax as binder, 90 pts.wt. of toluene as solvent, and 10 pts.wt. of isopropyl alcohol also as solvent.

Then, a thermal transfer recording medium 50 was produced on the same condition as Practice Example 1 except that this coating liquid was used instead of the melting type primer layer coating liquid used in Practice Example 1.

Each evaluation test of [Printing Test], [Reliability Test] and [Applicability Test] has been carried out using the thermal transfer recording media 50 of those Practice Examples 2 to 4, on the same condition as Practice Example 1, and the results thereof are described in the above table 1.

<Comparative Example 1>

A melting type primer layer coating liquid not containing styrene vinyl acetate copolymer was manufactured by mixing up 10 pts.wt. of brand name [Himer] manufactured by Sanyo Chemical Industries, Ltd., which is styrene resin and 90 pts.wt. of toluene, which is solvent.

A thermal transfer recording medium was manufactured on the same condition as Practice Example 1 except that this coating liquid was used instead of the melting type primer layer coating liquid used in Practice Example 1.

<Comparative Example 2>

A thermal transfer recording medium was manufactured on the same condition as Practice Example 1 except that brand name [Sumitate KC10] manufactured by Sumitomo Chemical Co., Ltd., which is ethylene vinyl acetate polymer, was used instead of styrene resin.

<Comparative Example 3>

A thermal transfer recording medium was manufactured on the same condition as Practice Example 1 except that carnauba wax was used instead of styrene resin.

<Comparative Example 4>

A thermal transfer recording medium was manufactured on the same condition as Practice Example 1 except that brand name [Elitel 3200] manufactured by Unitika Ltd., which is polyester resin, was used instead of styrene resin.

Each evaluation test of [Printing Test] and [Reliability Test] has been carried out using the thermal transfer recording media 50 of those Comparative Examples 1 to 4, on the same condition as Practice Example 1, and the results thereof are described in the above table 1.

As is obvious from the above table 1, the results of the printing test and the reliability test are particularly excellent regarding the thermal transfer recording media 50 of Practice Examples 1 to 4, and also in the applicability test sufficiently acceptable evaluation results were obtained for practical use.

Particularly, in Practice Example 4 in which polyethylene wax was added to the melting type primer layer $\mathbf{18}_1$, further favorable result was obtained in the applicability test. It is assumed that adding polyethylene wax had improved affinity between the melting type primer layer $\mathbf{18}_1$ and the black ink.

On the other hand, regarding Comparative Examples 1 to 4 in which the melting type primer layer $\mathbf{18}_1$ does not contain styrene vinyl acetate copolymer, reliability was sufficient, however, either of the result of exfoliation property or the result of overprint quality was not sufficient in the printing test, and it is not suitable for practical use.

Accordingly, it is understood that in the case where the main component of a melting type primer layer is styrene vinyl acetate copolymer, not only a melting type transfer portion excels in transferability, but also a printing layer to be formed and a protective portion become highly adhesive to each other.

As described above, favorable results are obtained in the case where the molarity of vinyl acetate in the styrene vinyl acetate copolymer is 10 mol % in Practice Example 1, 30 mol % in Practice Example 2 and 50 mol % in Practice Example 3, that is, 10 mol % or more and 50 mol % or less; and as to the styrene component and the vinyl acetate component, it is assumed that the vinyl acetate component enhances adhesiveness to a protective portion (protective layer). If a primer layer is made only of styrene vinyl acetate copolymer, 10 mol % of the vinyl acetate component in the copolymer is sufficient. However, the effectiveness may not be obtained satisfactorily if another resin component is also used, if a primer layer is made extremely thin, or if any other cases happen, so that it is desirable that the percentage be equal to or more than 10 mol %. Further, if vinyl acetate is contained more than 50 mol %, suddenly a primer layer becomes tacky. With such tackiness, when a melting type ink layer is applied thereon, smooth application will be hindered by the melting type ink layer becoming attached to an adjacent roll, so that other resin need to be used together.

Here, regarding the ethylene vinyl acetate copolymer (Sumitate KC-10) in Comparative Example 2, the molar ratio of vinyl acetate is 28%.

Although this is within the range of 10 mol % to 50 mol % in vinyl acetate concentration, no favorable results are obtained, because it is not styrene but ethylene that is used as a component, other than the vinyl acetate.

Further, it is desired that styrene vinyl acetate copolymer be contained 60 wt % or more in a primer layer, because otherwise it is diluted with other components, making it difficult for effectiveness according to the above-described present invention to occur.

As described above, when the thermal transfer recording medium of the present invention is used, a reliable printed matter can be obtained, because no lift is generated between a coloring portion of a printed matter and a protective film, and the protective film and a printing surface are highly adhesive to each other.

The invention claimed is:

1. A thermal transfer recording medium comprising a base sheet, a melting primer layer disposed on said base sheet, a sublimation transfer portion which is disposed on said base sheet and contains sublimation type ink, and a melting ink layer disposed on said melting primer layer, in which said melting primer layer and said melting ink layer constitute a melting transfer portion, said melting transfer portion is transferred to a printing object when heating said melting transfer portion, and a printing layer where a residual resin made of said primer layer material is exposed is formed;

wherein said melting primer layer is comprised of a styrene vinyl acetate copolymer of at least 60 wt %; and wherein when said sublimation transfer portion is heated in the state of being firmly in contact with said printing object, said sublimation ink sublimates and infiltrates into said printing object.

2. A thermal transfer recording medium according to claim 1, wherein said melting ink layer is formed of black ink containing carbon black which is a coloring agent.

3. A thermal transfer recording medium according to claim 1, wherein said styrene vinyl acetate copolymer contained in said melting primer layer is comprised of vinyl acetate of 10 mol % or more and 50 mol % or less.

4. A thermal transfer recording medium according to claim 1, wherein polyethylene wax is added to said melting primer layer.

5. A thermal transfer recording medium according to claim 1, further comprising a protective portion disposed on said base sheet, wherein when said protective portion is heated, a surface portion of said protective portion becomes adhesive with respect to said residual resin.

6. A thermal transfer recording medium according to claim 5, wherein said protective portion contains one kind of resin selected from a group consisting of acrylic resin, polyester resin, vinyl chloride resin, nitrocellulose resin and urethane resin.

* * * * *